US009630196B2

(12) United States Patent
Finstad et al.

(10) Patent No.: US 9,630,196 B2
(45) Date of Patent: Apr. 25, 2017

(54) AIRFLOW CONTROL FOR AN INTEGRATED HANDHELD TEXTURE SPRAYER

(71) Applicant: Graco Minnesota Inc., Minneapolis, MN (US)

(72) Inventors: Eric J. Finstad, Rogers, MN (US); Jeromy D. Horning, Albertville, MN (US); Robert W. Kinne, Columbia Heights, MN (US); Bret A. Deneson, Otsego, MN (US); Steve J. Wrobel, Rogers, MN (US); David M. Larsen, Albertville, MN (US); Barry W. Mattson, Elk River, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 14/762,973

(22) PCT Filed: Jan. 24, 2014

(86) PCT No.: PCT/US2014/012896
§ 371 (c)(1),
(2) Date: Jul. 23, 2015

(87) PCT Pub. No.: WO2014/116918
PCT Pub. Date: Jul. 31, 2014

(65) Prior Publication Data

US 2015/0367362 A1 Dec. 24, 2015

Related U.S. Application Data

(60) Provisional application No. 61/756,103, filed on Jan. 24, 2013.

(51) Int. Cl.
*B05B 1/28* (2006.01)
*B05B 7/24* (2006.01)
(Continued)

(52) U.S. Cl.
CPC ..... *B05B 7/2478* (2013.01); *B05B 7/02* (2013.01); *B05B 7/0416* (2013.01);
(Continued)

(58) Field of Classification Search
CPC ..... B05B 7/068; B05B 7/067; B05B 7/0815; B05B 7/2435; B05B 7/2478; B05B 7/0441
(Continued)

(56) References Cited

U.S. PATENT DOCUMENTS 1,998,592 A 4/1935 Schenk
2,064,125 A 12/1936 Norris
(Continued)

FOREIGN PATENT DOCUMENTS

JP 2002036438 A 12/2002
JP 2008161788 A 7/2008

OTHER PUBLICATIONS

International Search Report and Written Opinion from PCT Application Serial No. PCT/U52014/012896, dated May 19, 2015, 11 pages.

*Primary Examiner* — Davis Hwu
(74) *Attorney, Agent, or Firm* — Kinney & Lange, P.A.

(57) ABSTRACT

A handheld sprayer includes a housing, a turbine, a spray tip, and a hopper. An air flow passage extends through the housing. The turbine is configured to generate an airflow within the air flow passage. The spray tip is positioned to receive airflow from the air flow passage. The hopper is connected to the housing and configured to discharge a fluid into the air flow passage. In one embodiment a valve is positioned within the air flow passage and configured to control the airflow from the turbine to the spray tip. In another embodiment, a voltage limiting circuit is configured to control voltage to an electric motor of the turbine to
(Continued)

control speed of the turbine. In another embodiment, an air inlet control device is configured to control the air intake of the turbine.

19 Claims, 8 Drawing Sheets

(51) Int. Cl.
*B05B 7/02* (2006.01)
*B05B 7/04* (2006.01)
*B05B 7/14* (2006.01)

(52) U.S. Cl.
CPC ..... *B05B 7/1413* (2013.01); *B05B 7/2418* (2013.01); *B05B 7/2489* (2013.01)

(58) Field of Classification Search
USPC ..... 239/290, 291, 368, 419, 8
See application file for complete search history.

(56) References Cited

U.S. PATENT DOCUMENTS 2,179,871 A * 11/1939 Vogel ..... B05B 9/08 239/326
2,413,710 A 1/1947 Jason
2,736,606 A 2/1956 Kmiotek
3,157,360 A 11/1964 Heard
3,263,927 A 8/1966 Johnson
4,411,387 A 10/1983 Stern et al.
5,322,221 A * 6/1994 Anderson ..... B05B 7/068 239/291
5,415,351 A 5/1995 Otto et al.
5,915,627 A 6/1999 Plasko
5,979,797 A 11/1999 Castellano
6,386,845 B1 5/2002 Bedard
7,303,149 B1 * 12/2007 Huang ..... B05B 7/0815 239/290
7,374,111 B2 5/2008 Joseph et al.
7,731,104 B2 6/2010 Peterson et al.
7,762,476 B2 7/2010 Micheli
7,861,950 B2 1/2011 Rossner et al.
7,997,511 B2 8/2011 Reynolds et al.
8,210,449 B2 7/2012 Peterson et al.
2004/0089742 A1 5/2004 Antonucci
2009/0224076 A1 9/2009 Altenburger
2010/0090019 A1 4/2010 Peterson et al.
2011/0023776 A1 2/2011 Etzler et al.
2012/0181345 A1 7/2012 Mueller

* cited by examiner

AIRFLOW CONTROL FOR AN INTEGRATED HANDHELD TEXTURE SPRAYER

BACKGROUND

The present invention relates generally to handheld sprayers, and in particular to systems and methods for controlling airflow for integrated handheld sprayers.

Handheld texture sprayers are utilized, for example, to apply coatings to walls, ceilings, and/or other surfaces. These coatings may include, for example, "knockdown" finishes, "popcorn" finishes, and fine "orange peel" finishes. Texture sprayers are supplied a viscous material, such as, for example, drywall mud from a separate tank or an attached hopper. An airflow provided to the sprayer atomizes the fluid into a spray that is applied to a surface in order to create a desired finish.

In the past, the airflow has been provided from, for example, an external air compressor. These air compressors are often bulky and limit the mobility and convenience of the texture sprayer. To provide portability, these external air compressors have been replaced with a local airflow source, such as a turbine that is integrated with the sprayer. One such portable texture sprayer is disclosed in U.S. Pat. No. 7,731,104. While providing portability, these texture sprayers are limited in both the type and quality of finish they can provide. It is desirable to improve the type and quality of spray finishes that can be generated by handheld texture sprayers.

SUMMARY

A handheld sprayer includes a housing, a turbine, a spray tip, a hopper, a valve, and a control. An air flow passage extends through the housing. The turbine is configured to generate an airflow within the air flow passage. The spray tip is positioned to receive airflow from the air flow passage. The hopper is connected to the housing and configured to discharge a fluid into the air flow passage. The handheld sprayer further includes means for controlling the airflow within the air flow passage.

DETAILED DESCRIPTION

Disclosed herein is a handheld texture sprayer that provides control of the airflow provided to the spray tip from a turbine of the texture sprayer. The handheld texture sprayer includes a housing, a turbine, a spray tip, and a hopper. An air flow passage extends through the housing and carries an airflow generated by the turbine. The hopper is connected to the housing and holds fluid that is provided to the air flow passage. Using the generate airflow, the fluid is projected through the spray tip for application to a surface. In one embodiment, the air flow passage includes a valve configured to impede airflow from the turbine to the spray tip. The valve is moveable to control the airflow provided to the spray tip. In another embodiment, an electric circuit is configured to limit voltage to an electric motor of the turbine. The electric circuit is controllable to adjust the speed of the turbine to obtain a desired airflow to the spray tip. In another embodiment, an air intake control device is connected to the turbine to limit the air intake of the turbine. The air intake of the turbine is adjusted to control the airflow from the turbine to the spray tip. Control of the airflow from the turbine to the spray tip allows for greater control of the texture finish created by the sprayer.

Figure 1:
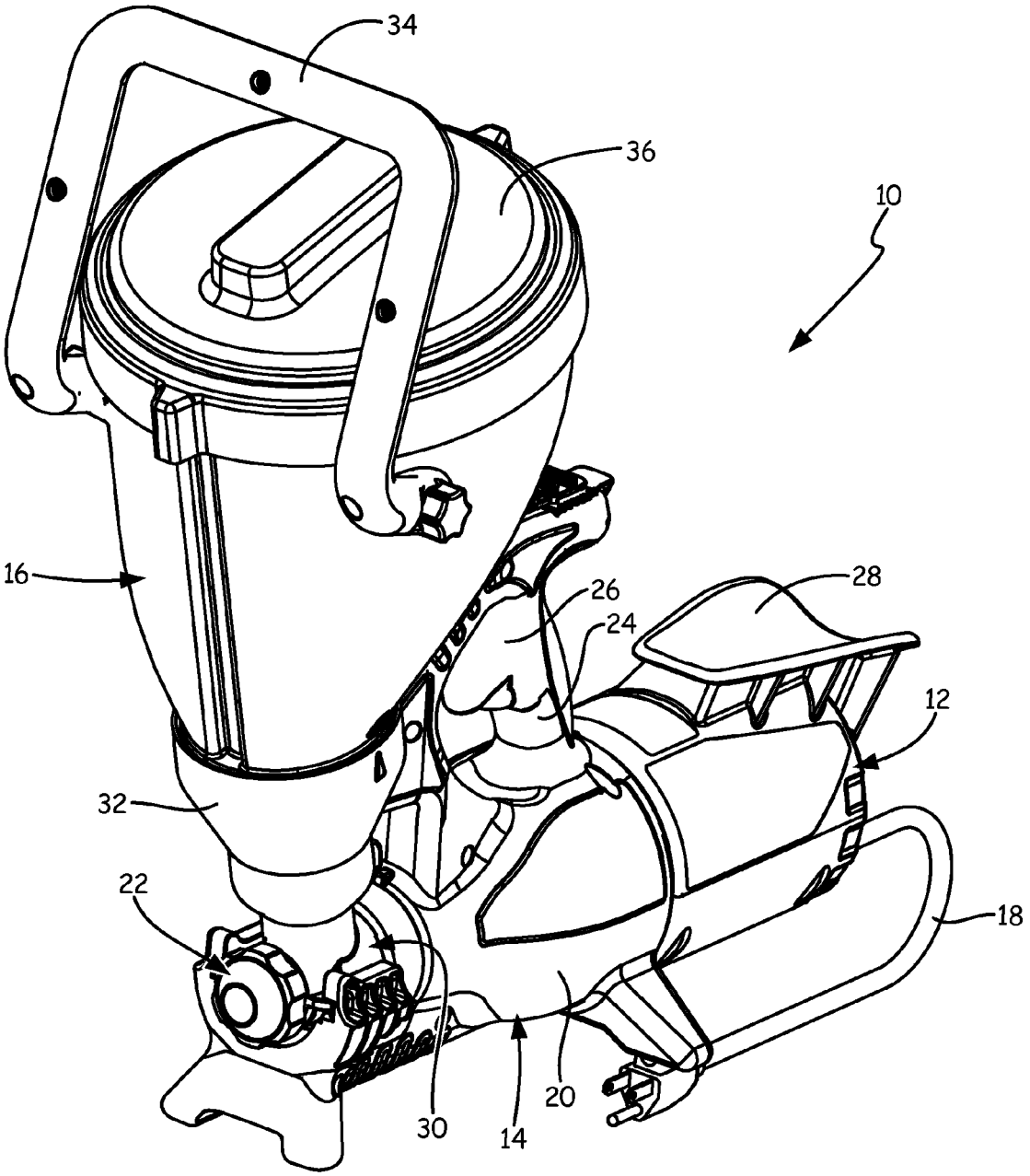
FIG. 1 is a perspective view of an integrated handheld texture sprayer having a turbine, a dispenser and a hopper.

FIG. 1 is a perspective view of integrated handheld texture sprayer 10 having turbine 12, dispenser 14 and hopper 16. In the described embodiments, sprayer 10 may be used to dispense a fluid having a texturizing additive, which is present in hopper 16. Dispenser 14 utilizes an airflow generated by turbine 12 to discharge the fluid in a spray pattern conducive for forming texturized finishes.

Turbine 12 utilizes electrical power from cord 18 to generate a flow of compressed air for pushing liquid from hopper 16 through dispenser 14. Turbine 12 is inserted into housing 20 of dispenser 14 to fluidly interact with spray tip 22. Housing 20 includes handle 24 into which is integrated trigger 26. An operator of sprayer 10 grasps handle 24 with a hand while resting a forearm on pad 28 so that trigger 26 can be actuated with one or more fingers. Turbine 12 is activated via a power switch (FIG. 3) in order to produce the pressurized air via rotation of an impeller, fan or the like. Upon actuation of trigger 26, a valve behind spray tip 22 is opened that simultaneously allows fluid from hopper 16 to enter mix chamber 30 through funnel 32, and air from turbine 12 to enter mix chamber 30 through housing 20. Spray tip 22 is interchangeable so that different patterns can be sprayed. For texture sprayers, spray tip 22 includes an opening sufficiently large to discharge fluid and texturizing particles. Hopper 16 also includes handle 34 and lid 36 so that sprayer 10 can be easily grasped to orientate spray tip 22 upward without fluid overflowing from hopper 16.

Figure 2:
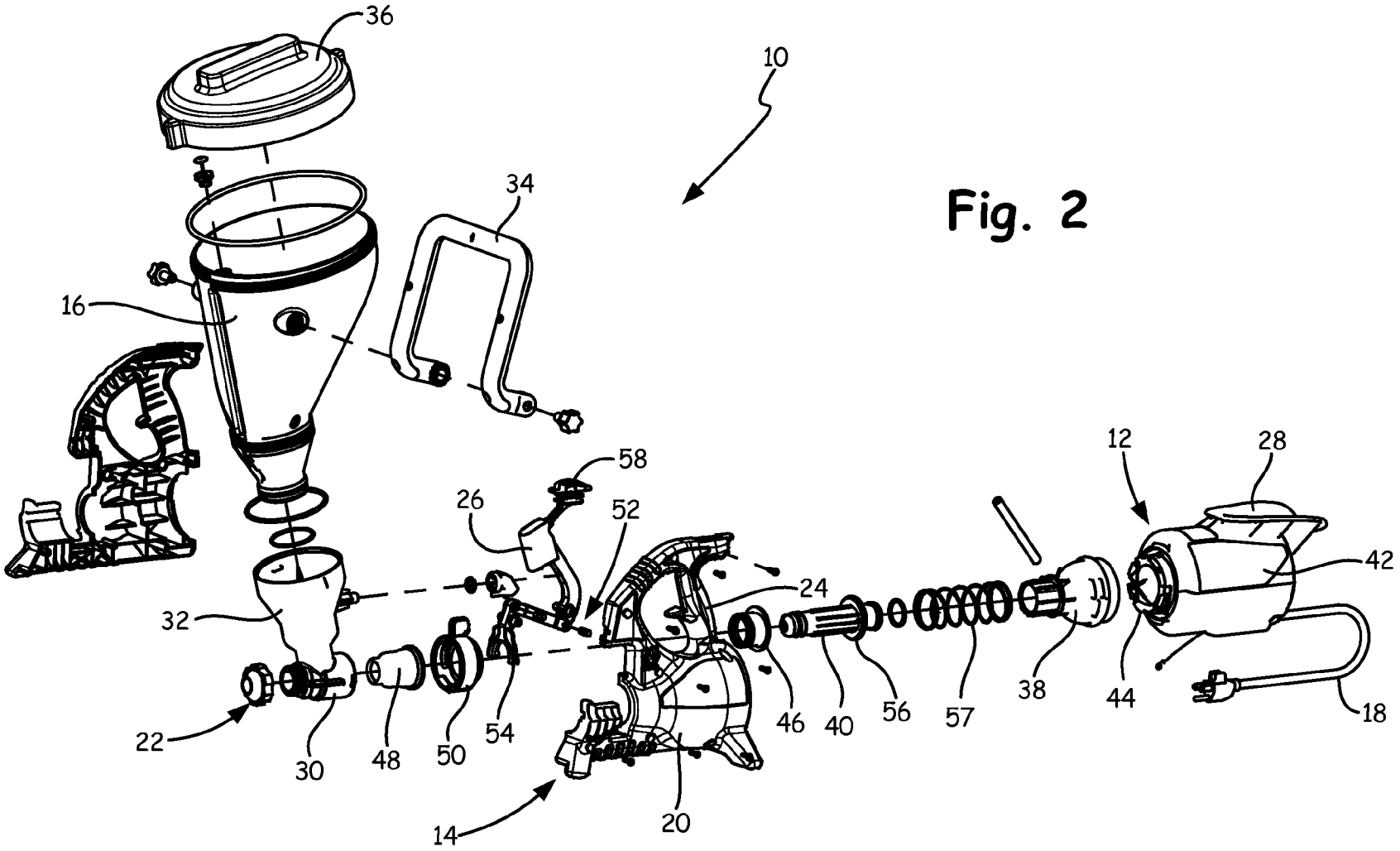
FIG. 2 is an exploded view of the texture sprayer of FIG. 1 showing an air flow path from the turbine, through a plenum and piston within the dispenser and to a spray tip.
Figure 3:
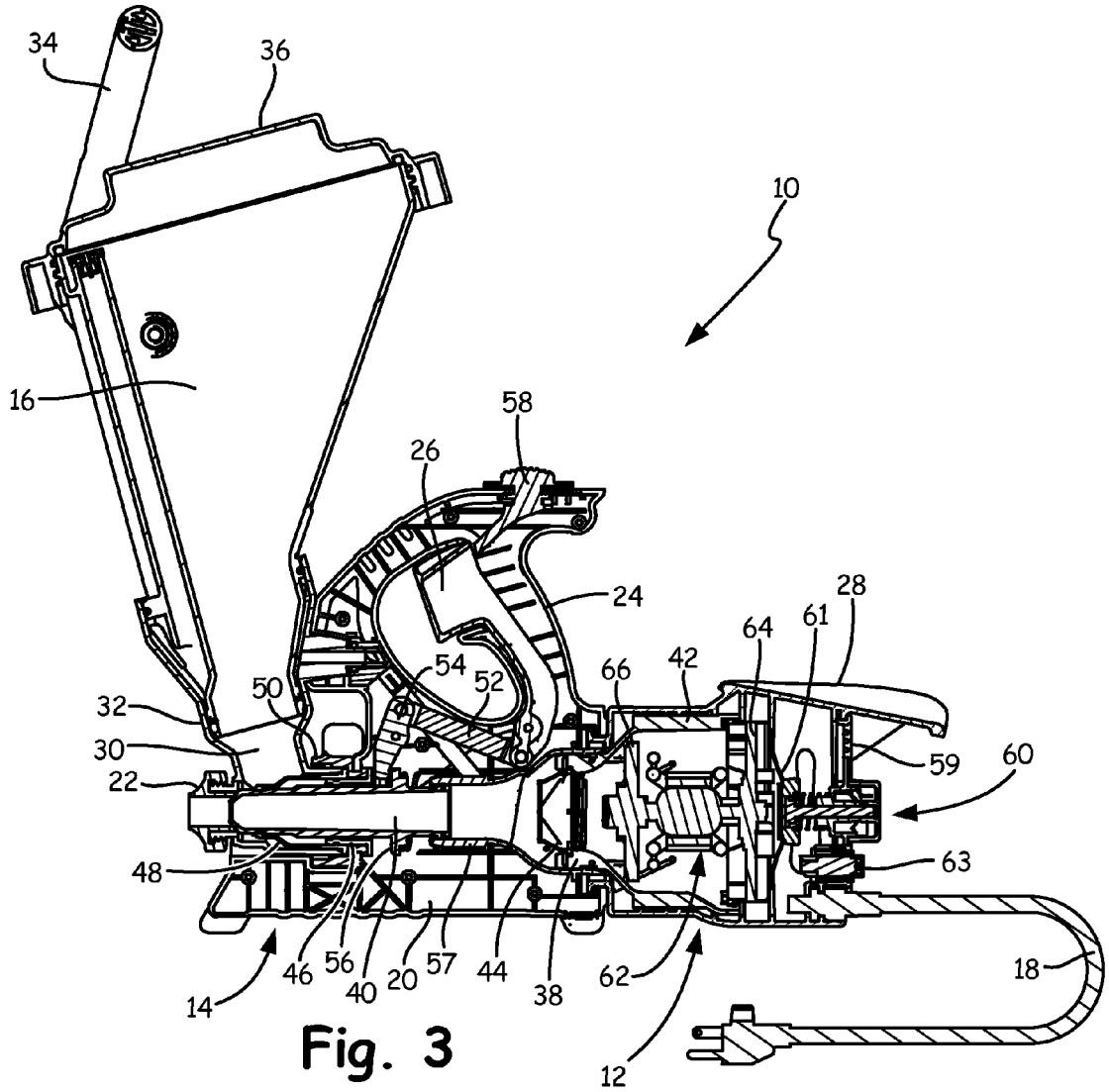
FIG. 3 is cross-sectional view of the texture sprayer of FIG. 2 showing interconnection of the turbine, a trigger, the piston and the spray tip.

FIG. 2 is an exploded view of texture sprayer 10 of FIG. 1 showing an air flow path from turbine 12, through plenum 38 and piston 40 within dispenser 14, to spray tip 22. Plenum 38 connects to housing 42 of turbine 12 to receive pressurized air from outlet 44. Piston 40 is slidable between plenum 38 and spray tip 22. Piston 40 is supported within housing 20 and mix chamber 30 via bushing 46 and sleeve 48. Collar 50 couples mix chamber 30 to housing 20, with bushing 46 and sleeve 48 being retained between via flanges (as can be seen in FIG. 3). Spray tip 20 is threaded onto an outlet opening in mix chamber 30. Trigger 26 is coupled to piston 40 via linkage 52 and yoke 54, which engages flange 56 on piston 40. Spring 57 is positioned around portions of plenum 38 and piston 40. Trigger lock 58 is slidable within housing 20 above handle 24 to limit movement of trigger 26.

As will be discussed in more detail with reference to FIG. 3, turbine 12 generates an airflow that passes from turbine exit 44 into plenum 38, which directs the airflow into piston 40 that extends through housing 20 to spray tip 22. Piston 40 is biased toward spray tip 22 via spring 57 to prevent fluid within hopper 16 from entering mix chamber 30 without actuation of trigger 26. Retraction of trigger 26 into handle 24 pulls piston 40 away from spray tip 22 via interaction of linkage 52 and yoke 54 with flange 56. Fluid stored within hopper 16 is allowed to drop, or otherwise flow, into mix chamber 30 and, with piston 40 disengaged from spay tip 22, the fluid is forced into and out of spray tip 22 by the passage of air from piston 40 to spray tip 22.

FIG. 3 is cross-sectional view of texture sprayer 10 of FIG. 2 showing interconnection of turbine 12, plenum 38, piston 40, trigger 26 and spray tip 22. Air is permitted into housing 20 of sprayer 10 via inlet vent 59. In the embodiment shown, flow of air from inlet vent 59 into turbine inlet 61 of turbine 12 is controlled with airflow control 60. Motor 62 is disposed within housing 20 between turbine inlet 61 and plenum 38. Motor 62 may comprise any suitable AC or DC magneto-electric machine that produces rotational output. Thus, activation of motor 62 causes fan 66 to draw air through inlet vent 59 and turbine inlet 61. Motor 62 is activated by switch 63, which may comprise a rocker switch that allows power from cord 18 to motor 62. Thus, motor 62 and turbine 12 provide a continuous flow of air through sprayer 12 so long a switch 63 is activated.

Turbine 12 pushes air into plenum 38 at turbine outlet 44. Piston 40 guides air from plenum 40 to spray tip 22. Spray tip 22 and piston 40 form a seal when engaged in a closed position to prevent air from being in fluid communication with mix chamber 30. Spring 57 pushes between flange 56 and plenum 38 to bias piston 40 to the closed position. In order to move piston 40 to an open position, trigger 26 is translated, such as by an operator of sprayer 10, away from spray tip 22 (to the right in FIG. 3). Linkage 52 pulls yoke 54 to push flange 56 and piston 40 to an open position away from spray tip 22 such that mix chamber 30 is put into fluid communication with airflow from piston 40.

Moving piston 40 from the closed position to the open position allows fluid from within hopper 16 that is present within mix chamber 30 to enter the air flow path between spray tip 22 and piston 40. In one embodiment, the fluid is pushed into the air flow path primarily via gravity. Additionally, the flow of compressed air between piston 40 and spray tip 22 generates a slight vacuum that pulls in fluid from hopper 16. As such, the flow of air through piston 40 pulls the fluid along through spray tip 22.

The pattern of the sprayed fluid can be adjusted by changing the amount that trigger 26 is actuated. Retracting trigger 26 further into handle 24 allows for more fluid to enter spray tip 22, thereby resulting in a more dense spray pattern. Trigger lock 58 is adjustable to limit the movement of trigger 26. For example, trigger lock 58 can be locked into different positions along the top of handle 24 to provide a barrier to translation of trigger 26 into handle 24. Trigger lock 58 is provided on handle 24 in a location convenient for an operator of sprayer 12 to access, such as with a thumb. Furthermore, the spray pattern can be adjusted by swapping out spray tip 22 for other spray tips having different sized openings that will widen or narrow the pattern of discharged fluid from sprayer 10.

Figure 4A:
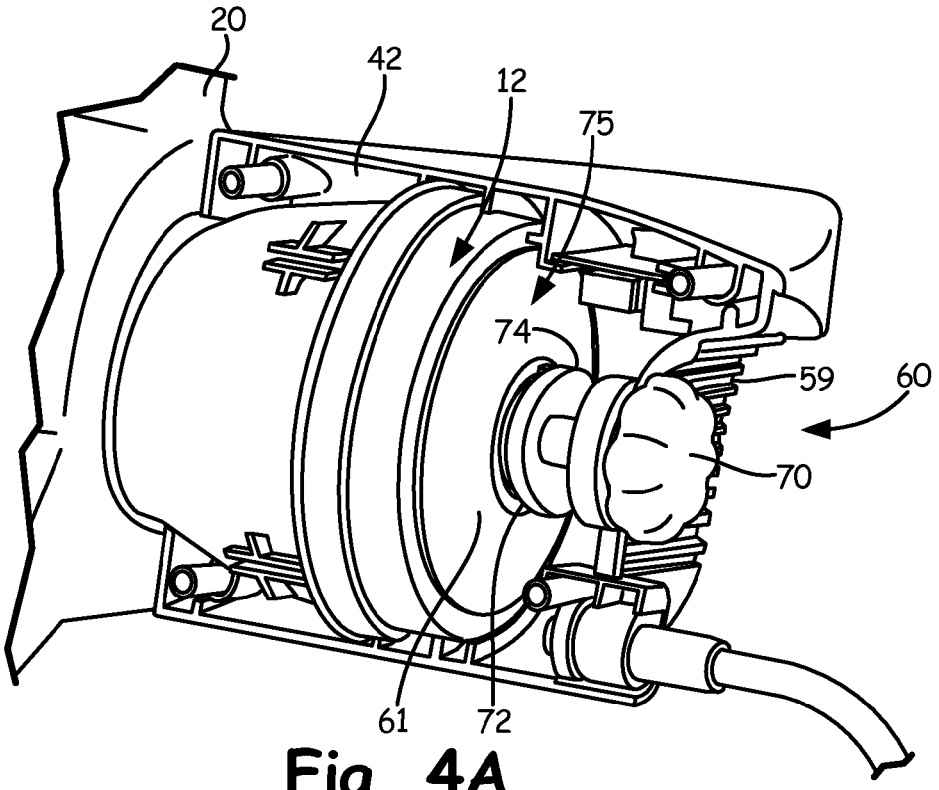
FIGS. 4A and 4B are perspective views of the turbine with the housing cut away to show an airflow control in a closed and an open position, respectively.
Figure 4B:
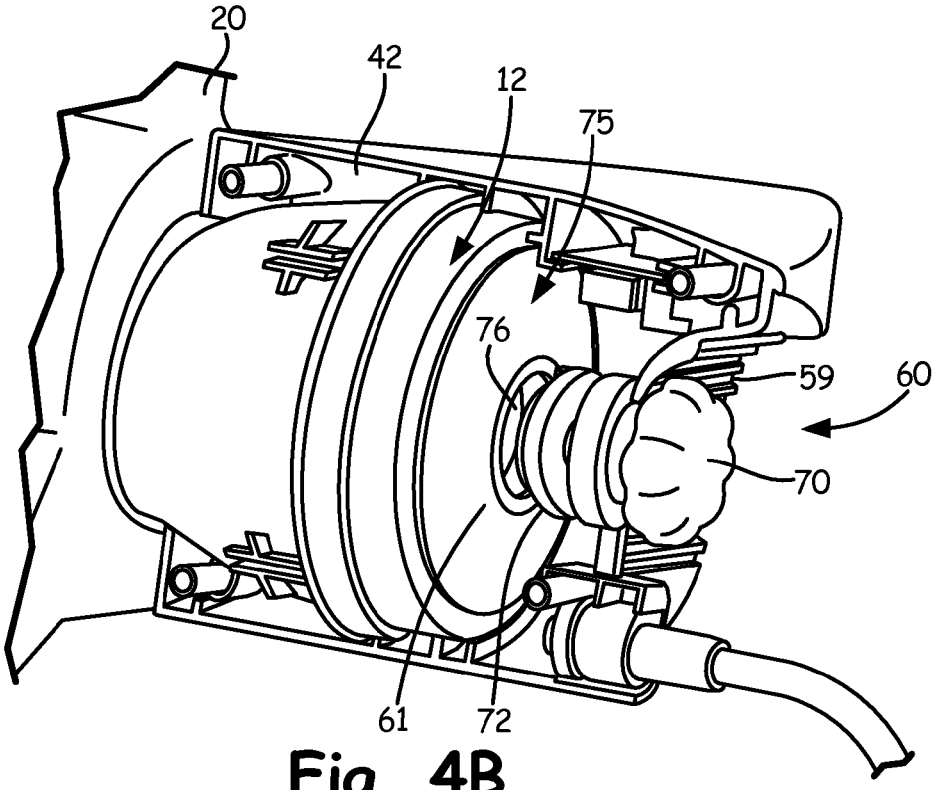

FIGS. 4A and 4B, discussed concurrently, are perspective views of turbine 12 with housing 42 of turbine 12 cut away to show airflow control 60 in a closed position and an open position, respectively. Airflow control 60 includes knob 70, plunger 72, and screw 74 (FIG. 4A).

Air is initially brought into turbine 12 through inlet vent 59 to plenum 75 formed within the housing of turbine 12 between inlet vent 59 and turbine inlet 61. Turbine inlet 61 includes air intake port 76 (FIG. 4B) that provides the air from vent 59 to turbine 12. FIG. 4*a* illustrates airflow control 60 in the closed position. In the closed position, plunger 72 may completely block the air through air intake port 76 of turbine inlet 61. In this case, no air is provided to turbine 12, and thus, no airflow is provided from turbine 12 to housing 20 of handheld sprayer 10.

FIG. 4B illustrates airflow control 60 in an open position. In an open position, plunger 72 is retracted from air intake port 76 allowing air into turbine 12. Plunger 72 may be retracted any distance from air intake port 76 limited by housing 20. Knob 70 is turned to move plunger 72 through screw 74. Knob 70 may provide linear control of the position of plunger 72, or knob 70 may also provide specific preset positions for plunger 72. Preset positions may be accomplished using, for example, mechanical detents. As plunger 72 is retracted further away from air intake port 76, the air intake of turbine 12 is increased. When fully retracted, air intake into turbine 12 is not limited relative to the capacity of turbine 12.

Reducing the air intake to turbine 12 reduces the airflow generated by turbine 12 and provided to spray tip 22. Control of airflow from turbine 12 to spray tip 22 is desirable to allow for better control of texture finishes created by texture sprayer 10. For example, less airflow may be desirable for creating heavy "knockdown" finishes while greater airflow may be desirable for creating fine "orange peel" finishes. While illustrated as a knob, screw and plunger, airflow control 60 may be implemented in any way that allows control of the intake air to turbine 12.

Figure 5:
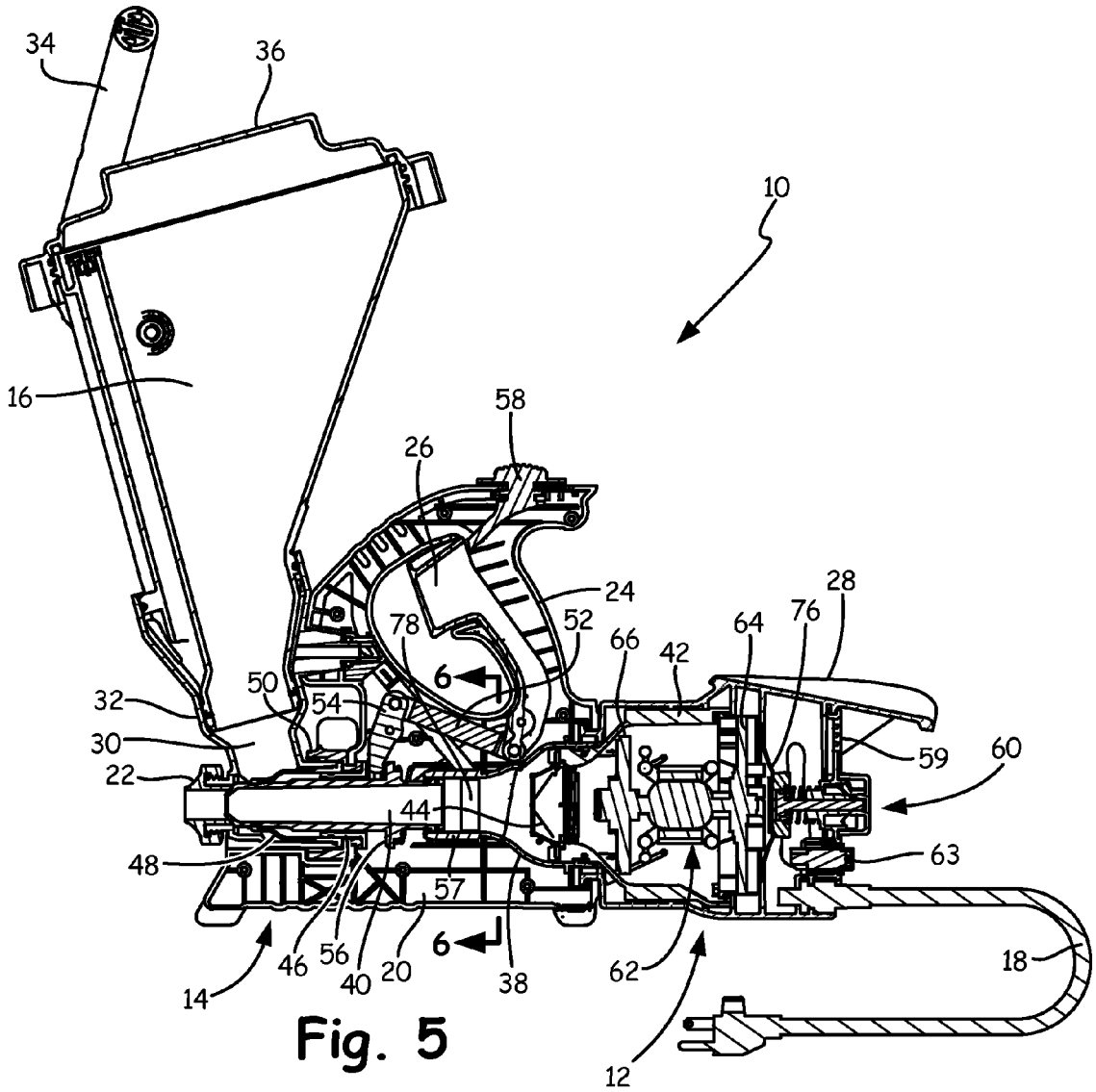
FIG. 5 is a cross-sectional view of the texture sprayer showing an airflow limiting device in the air flow path between the turbine and the spray tip.

FIG. 5 is a cross-sectional view of texture sprayer 10 showing airflow limiting valve 78 in the air flow passage between turbine 12 and spray tip 22. Air is brought into turbine 12 through inlet vent 59 and air intake port 76. Airflow is provided by turbine 12 at outlet 44 into plenum 38. The air flows through plenum 38 into the air flow passage through piston 40 to spray tip 22. When piston 40 is retracted, the fluid held in hopper 16 is provided to the outlet of piston 40. The airflow from piston 40 sprays the fluid through spray tip 22. The airflow through piston 40 may be controlled by valve 78 to allow for control of the texture finish created by the atomized material through spray tip 22.

Airflow limiting valve 78 is positioned within, for example, plenum 38 to control airflow from turbine 12 to the air flow passage through piston 40. Valve 78 is controllable to impede the airflow from turbine 12 to the air flow passage through piston 40. If in a fully closed position, no air will flow to the air flow passage through piston 40 and thus, no spray will be produced through spray tip 22. As valve 78 is opened, air will begin to flow through the air flow passage of piston 40, producing a texture spray. The amount of airflow through valve 78 dictates the texture finish created by the spray produced through spray tip 22. By controlling the airflow from turbine 12 to spray tip 22, better control of the texture finish produced by texture sprayer 10 is accomplished.

Figure 6A:
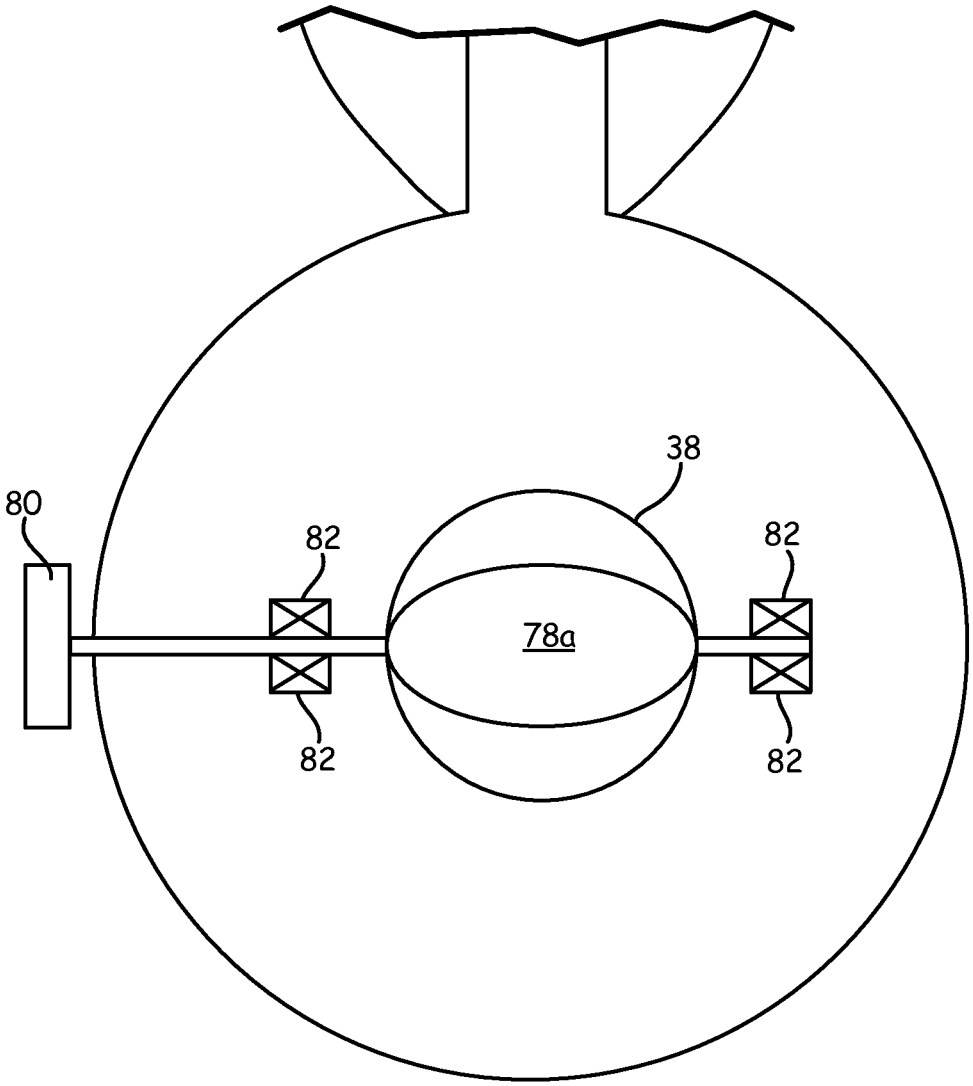
FIGS. 6A and 6B are cross-sectional views of the texture sprayer taken along line 6-6 of FIG. 5 showing multiple embodiments of the airflow limiting device in the path between the turbine and the spray tip.
Figure 6B:
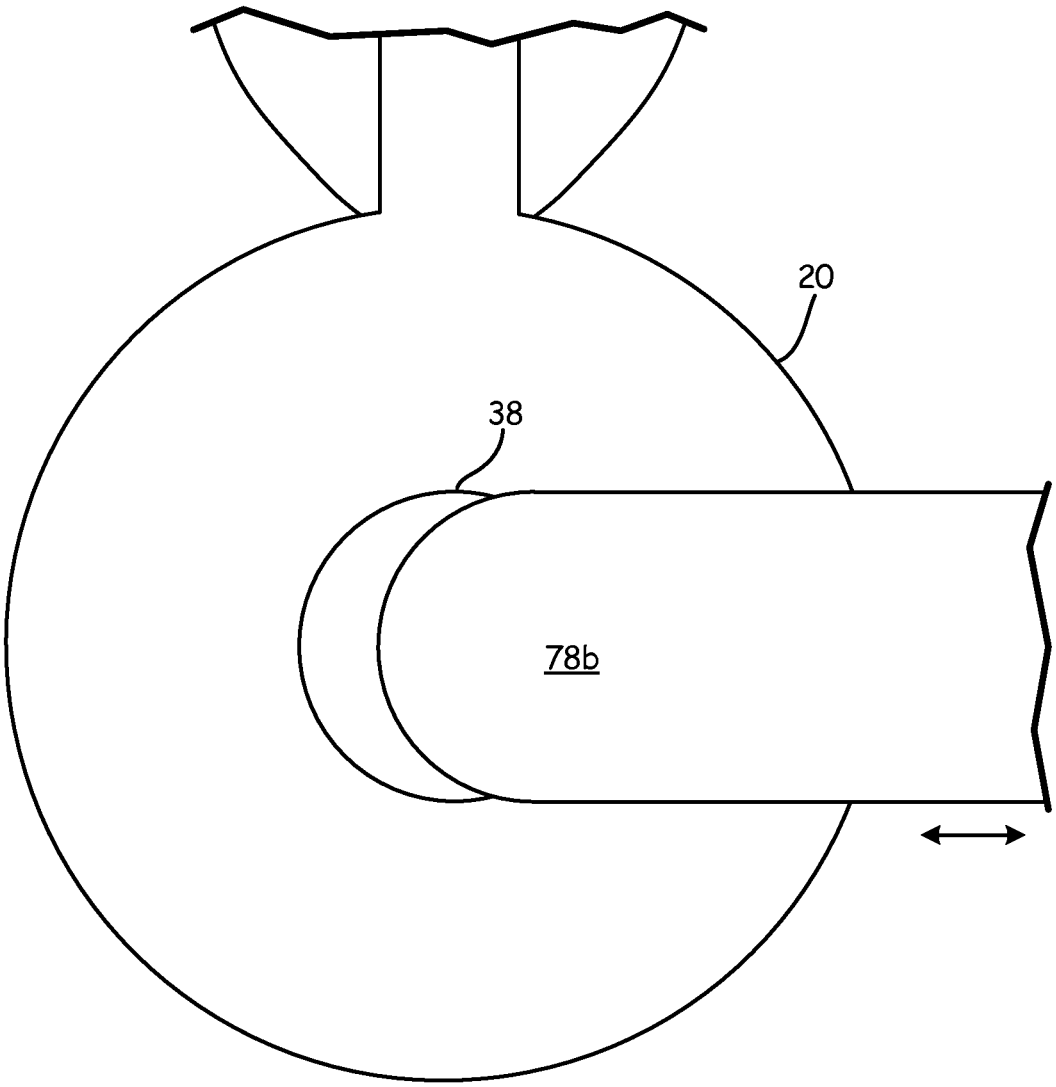

FIGS. 6A and 6B are cross-sectional views of texture sprayer 10 taken along line 6-6 of FIG. 5 showing multiple embodiments of airflow limiting valve 78 in the path between turbine 12 and the spray tip 22. FIG. 6*a* illustrates rotary vane 78*a* controlled by knob 80 through shaft 81. While illustrated within plenum 38, rotary vane 78*a* may be located at any point within the air flow passage from turbine 12 to spray tip 22 in order to control the airflow from turbine 12. Shaft 81 is rotated on bearings 82. Bearings 82 may be mounted onto the walls of plenum 38. In the embodiment shown in FIG. 6*a*, rotary vane 78*a* is illustrated in a partially open position. Knob 80 may linearly control the rotary position of vane 78*a*, or may include preset positions for vane 78*a* based upon, for example, desired airflows. These preset positions may be accomplished using, for example, mechanical detents. Knob 80 may be located external to housing 20 in order to allow for easy access and control by an operator of texture sprayer 10.

FIG. 6*b* illustrates sliding gate 78*b* positioned within a slot in plenum 38. Although illustrated within plenum 38, sliding gate 78*b* may be positioned at any point within the air flow passage from turbine 12 to spray tip 22 to control airflow. The position of sliding gate 78*b* is controlled by physically moving sliding gate 78*b* in the direction illustrated by the arrow in FIG. 6*b*. Movement of sliding gate 78*b* may be accomplished by an operator of texture sprayer 10 utilizing the portion of sliding gate 78*b* that is external to housing 20. The position of sliding gate 78*b* may be linearly controlled, and/or contain preset positions selected based upon desired airflows to spray tip 22. Preset positions may be accomplished using, for example, mechanical detents. Sliding gate 78*b* may be positioned between a fully open position, allowing full airflow through plenum 38, and a fully closed position blocking all airflow through plenum 38. A mechanical stop may be provided to prevent pulling sliding gate 78*b* completely out of hosing 20. Movement of sliding gate 78*b* into plenum 38 is limited by the wall of plenum 38.

Figure 7:
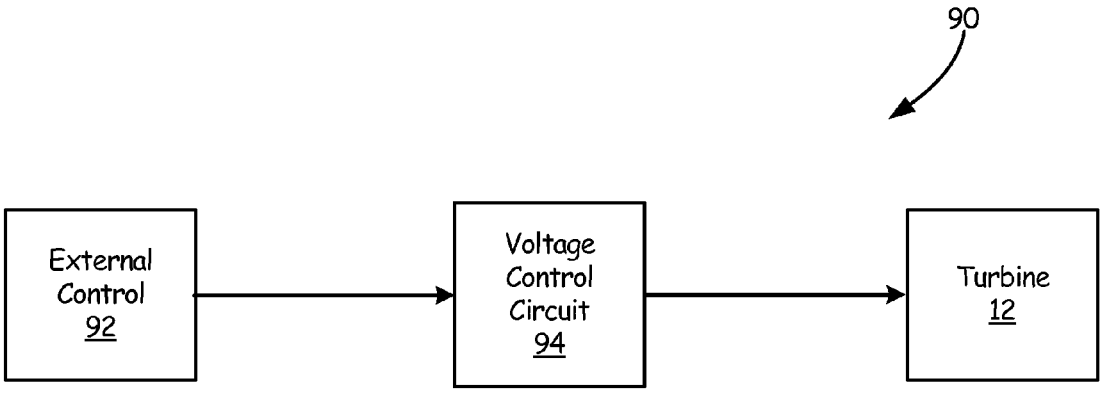
FIG. 7 is a block diagram illustrating a speed limiting device for the turbine of the texture sprayer.

FIG. 7 is a block diagram illustrating speed limiting system 90 for turbine 12 of texture sprayer 10. Speed limiting system 90 includes external control 92 and voltage control circuit 94. Voltage control circuit 94 controls the voltage provided to turbine 12. Because turbine 12 is driven by electric motor 62, the speed of turbine 12 may be controlled by controlling the voltage provided to motor 62.

In one embodiment, voltage control circuit 94 may include a rotary potentiometer and a triode for alternating current (TRIAC). The rotary potentiometer is used to control the TRIAC. The TRIAC provides, for example, phase-fired control for motor 62. This provides voltage control for motor 62, which in turn allows for control of the speed of turbine 12. Controlling the speed of turbine 12 controls the airflow provided by turbine 12 to spray tip 22. This allows for greater control of the texture finish produced by texture sprayer 10. External control 92 may be, for example, a knob of the rotary potentiometer. The knob of the rotary potentiometer may be, for example, located external to turbine 12 in order to provide easy access to an operator of texture sprayer 10.

In another embodiment, voltage control circuit 94 may include variable resistors and a TRIAC and external control 92 may be a rotary wheel. The rotary wheel may be located external to turbine 12 to provide easy access to an operator of texture sprayer 10. The rotary wheel controls variable resistors, which in turn control the TRIAC. The TRIAC provides, for example, phase-fired control for motor 62. The rotary wheel may allow linear control of the variable resistors, and/or may include presets based upon desired speeds of turbine 12. Control of the speed of turbine 12 allows direct control of the finishes produced by texture sprayer 10.

Although the present invention has been described with reference to preferred embodiments, workers skilled in the art will recognize that changes may be made in form and detail without departing from the spirit and scope of the invention.

The invention claimed is:

1. A handheld sprayer comprising:

a housing through which an air flow passage extends;

a turbine configured to generate an airflow within the air flow passage;

a spray tip positioned to receive airflow from the air flow passage;

a hopper connected to the housing and configured to discharge a fluid into the air flow passage; and an airflow control apparatus selected from a group consisting of:

a rotary vane that rotates to impede airflow from the turbine to the spray tip to control the airflow from the turbine to the spray tip, and a vane control external to the housing that controls the vane;

a sliding gate positioned within the airflow passage and configured to control the airflow from the turbine to the spray tip, and a gate control external to the housing that controls the sliding gate;

a voltage limiting circuit configured to control voltage to an electric motor of the turbine in order to control the speed of the turbine, and a circuit control external to the housing that controls the voltage limiting circuit in order to control the airflow generated by the turbine; and a plunger moveable to impede the inlet air to the turbine and configured to control the inlet air to the turbine in order to control the airflow generated by the turbine, and a knob external to the turbine that controls movement of the plunger through a screw.

2. The handheld sprayer of claim 1, wherein the airflow control apparatus comprises the rotary vane that rotates to impede the airflow from the turbine to the spray tip to control the airflow from the turbine to the spray tip, and the vane control external to the housing that controls the vane.

3. The handheld sprayer of claim 2, wherein the vane control is a knob connected to rotate the rotary vane.

4. The handheld sprayer of claim 1, wherein the airflow control apparatus comprises the sliding gate positioned within the airflow passage and configured to control the airflow from the turbine to the spray tip, and the gate control external to the housing that controls the sliding gate.

5. The handheld sprayer of claim 4, wherein the gate control is a portion of the sliding gate that extends external to the housing to allow control of the movement of the sliding gate.

6. The handheld sprayer of claim 1, wherein the airflow control apparatus comprises:

the voltage limiting circuit configured to control the voltage to the electric motor of the turbine in order to control the speed of the turbine; and the circuit control external to the housing that controls the voltage limiting circuit in order to control the airflow generated by the turbine.

7. The handheld sprayer of claim 6, wherein the voltage limiting circuit comprises at least one variable resistor and a TRIAC.

8. The handheld sprayer of claim 7, wherein one of the at least one variable resistors is a rotary potentiometer, and wherein the circuit control is a knob connected to the rotary potentiometer.

9. The handheld sprayer of claim 7, wherein the circuit control is a rotary wheel that linearly controls the voltage to the turbine through the at least one variable resistor and the TRIAC.

10. The handheld sprayer of claim 1, wherein the airflow control apparatus comprises:

the plunger moveable to impede the inlet air to the turbine and configured to control the inlet air to the turbine in order to control the airflow generated by the turbine, and the knob external to the turbine that controls the movement of the plunger through the screw.

11. The handheld sprayer of claim 10, wherein the turbine comprises:

an air vent inlet;

an air intake port; and a plenum through which air passes from the air vent inlet to the air intake port.

12. The handheld sprayer of claim 11, wherein the plunger is moveable within the plenum to impede the air provided to the air intake port in order to control inlet air to the turbine.

13. A method for spraying a fluid from a handheld sprayer, the method comprising:

generating an airflow with a turbine;

directing the airflow through a passage within the sprayer to a spray tip;

selectively discharging a fluid into the passage from a hopper for spraying through the spray tip; and controlling the airflow through the passage within the sprayer, wherein controlling the airflow through the passage is selected from a group consisting of:

impeding the airflow through the passage using a rotary vane positioned within the passage, and controlling, using a knob, the rotary vane to control the airflow through the passage;

impeding the airflow through the passage using a sliding gate positioned within the passage, and controlling the sliding gate using a portion of the sliding gate that is external to the sprayer; and limiting, using a voltage limiting circuit, the voltage provided to a motor of the turbine, and controlling the voltage limiting circuit to control the speed of the turbine.

14. The method of claim 13, wherein controlling the airflow through the passage within the sprayer comprises:

impeding the airflow through the passage using the rotary vane positioned within the passage; and controlling, using the knob, the rotary vane to control the airflow through the passage.

15. The method of claim 13, wherein controlling the airflow through the passage within the sprayer comprises:

impeding the airflow through the passage using the sliding gate positioned within the passage; and controlling the sliding gate using the portion of the sliding gate that is external to the sprayer.

16. The method of claim 13, wherein controlling the airflow through the passage within the sprayer comprises:

limiting, using the voltage limiting circuit, the voltage provided to the motor of the turbine; and controlling the voltage limiting circuit to control the speed of the turbine.

17. The method of claim 16, wherein the voltage limiting circuit comprises a rotary potentiometer and a TRIAC, and wherein controlling the voltage limiting circuit comprises controlling, using a knob of the rotary potentiometer, the voltage limiting circuit to control the speed of the turbine.

18. The method of claim 16, wherein the voltage limiting circuit comprises at least one variable transistor and a TRIAC, and wherein controlling the voltage limiting circuit comprises controlling, using a rotary wheel knob external to the sprayer, the at least one variable transistor to control the speed of the turbine.

19. A handheld sprayer comprising:

a housing through which an air flow passage extends;

a turbine configured to generate an airflow within the air flow passage;

a spray tip positioned to receive airflow from the air flow passage;

a hopper connected to the housing and configured to discharge a fluid into the air flow passage;

a rotary vane selectively positionable within the air flow passage to controllably impede airflow from the turbine to the spray tip; and a plate control external to the housing that controls an angular position of the rotary vane to control the airflow from the turbine to the spray tip.

* * * * *